United States Patent [19]

Chen

[11] Patent Number: 4,646,474

[45] Date of Patent: Mar. 3, 1987

[54] DRILL GRINDER

[76] Inventor: Jing-Rong Chen, No. 205, Sec. 2, An Ho Road, Hsin Tien City, Taipei Hsien, Taiwan

[21] Appl. No.: 806,905

[22] Filed: Dec. 9, 1985

[51] Int. Cl.[4] ..... B24B 3/26

[52] U.S. Cl. ..... 51/124 R; 51/219 R

[58] Field of Search ..... 51/124 R, 218 R, 219 R, 51/219 PC

[56] References Cited

U.S. PATENT DOCUMENTS 3,521,405 7/1970 Mackey, Jr. et al. ..... 51/124 R
4,471,581 9/1984 Bernard et al. ..... 51/124 R

FOREIGN PATENT DOCUMENTS 3039649 5/1982 Fed. Rep. of Germany .... 51/219 R
2026357 2/1980 United Kingdom ..... 51/219 R

*Primary Examiner*—Frederick R. Schmidt

*Assistant Examiner*—Robert A. Rose

*Attorney, Agent, or Firm*—Armstrong, Nikaido, Marmelstein & Kubovcik

[57] ABSTRACT

This invention relates to an improved drill grinder and particularly to one which comprises a main frame. A grinding wheel is disposed on one end of the main frame. A stand is located on the slidable seats which are disposed on the other end of the main frame. The stand is provided with a handle which is used to drive a block in a predetermined manner. A sliding seat having a supporting plate is slidably secured to the block. A clamp having a drill bit clamped therein is disposed on the supporting plate of the sliding seat. In operation, the relative position between the drill bit and the grinding wheel is predetermined by means of adjusting a positioning seat and the sliding seat thereby easily and accurately obtaining the desired clearance angle and point angle of the drill bit.

1 Claim, 11 Drawing Figures

DRILL GRINDER

BACKGROUND OF THE INVENTION

This invention relates to an improved drill grinder.

The clearance angle (as defined in FIG. 9-1) and the point angle P (as defined in FIG. 9-2) of a drill bit usually have various specifications in order to meet the requirements of different purposes. However, the desired clearance and point angles of a drill bit have to be obtained by manually controlling the conventional drill grinder therefore it is difficult to achieve the accurate clearance angle or point angl e therefrom.

It is, therefore, an object of the present invention to obviate and mitigate the above-noted drawback.

SUMMARY OF THE INVENTION

It is the primary object of the present invention to provide an improved drill grinder which can be correctly and quickly operated and is applicable to any sizes of drill bits.

It is another object of the present invention to provide an improved drill grinder which is so simple to operate that even an unskilled person can produce perfect product within a short period.

It is still another object of the present invention to provide an improved drill grinder which is economic to fabricate.

It is a further object of the present invention to provide an improved drill grinder which is practical for use.

BRIEF DESCRIPTION OF THE DRAWINGS

FIG. 5-1 shows that the positioning seat cooperates with the clamping means to adjust the position of the drill bit clamped therein;

FIG. 5-2 is a side view of the clamping means wherein the drill bit is clamped between the first and the second seats;

FIG. 9-1 shows the clearance angle of a drill bit; and

FIG. 9-2 shows the point angle of a drill bit.

DETAILED DESCRIPTION OF THE PREFERRED EMBODIMENT

Figure 1:
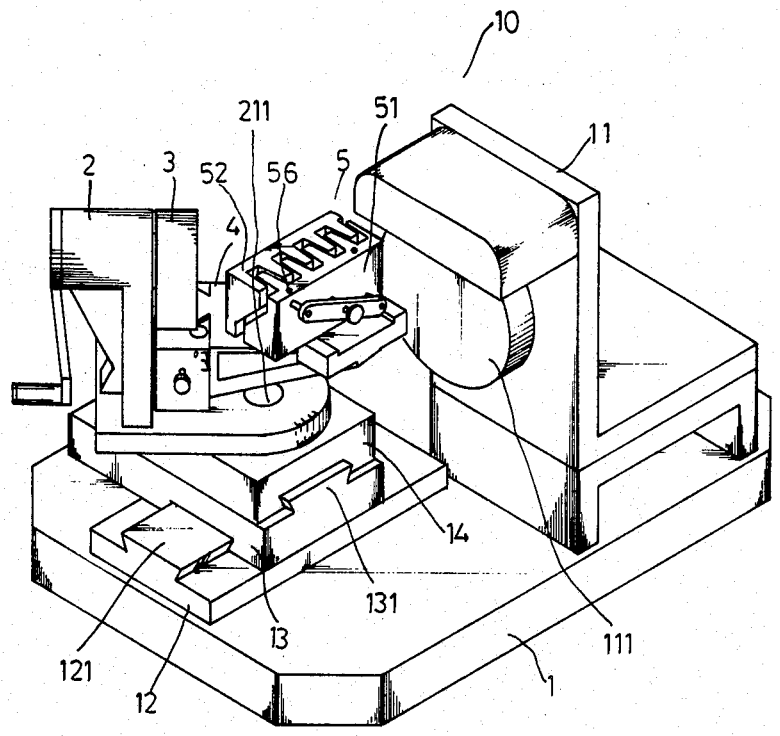
FIG. 1 is a perspective view of a preferred embodiment of the present invention.
Figure 2:
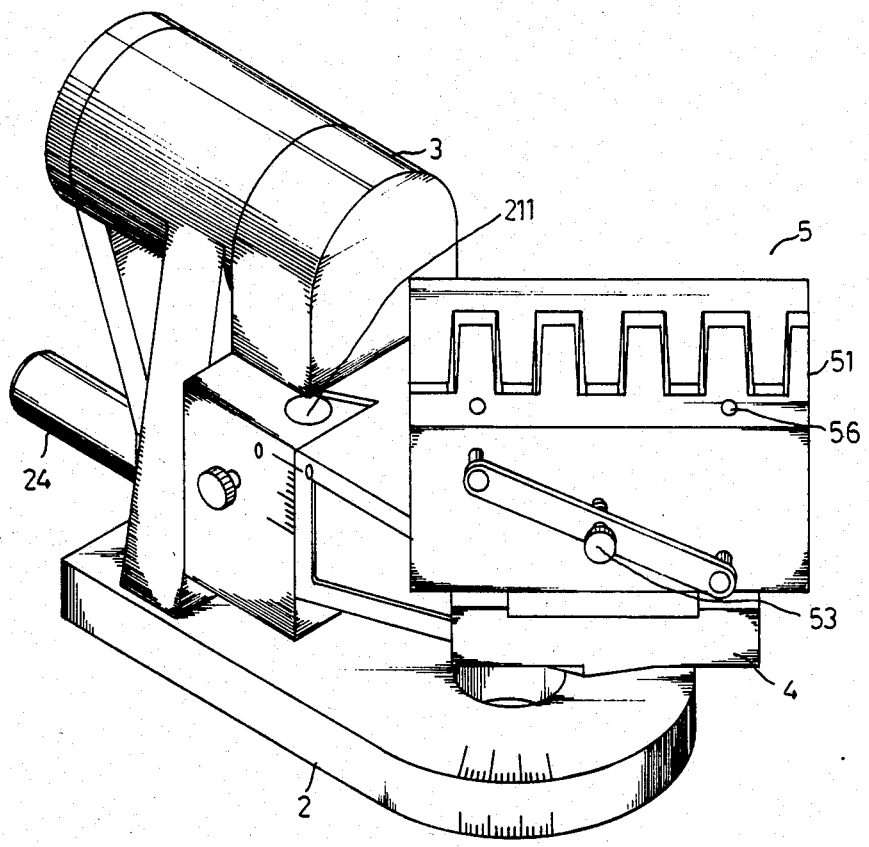
FIG. 2 is a local perspective view of a preferred embodiment of the present invention.
Figure 3:
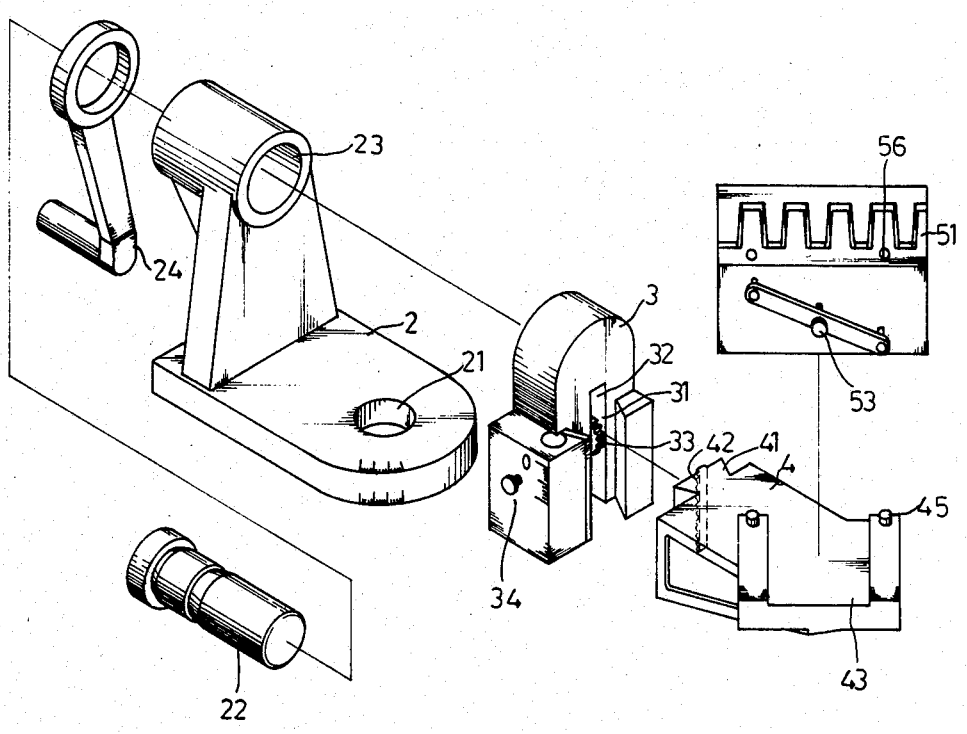
FIG. 3 is a fragmental perspective view of FIG. 2.

Referring to the drawings and particularly to FIGS. 1 to 3, an improved drill grinder (10) comprises a main frame (1) which is provided with a grinding means (11) on which a grinding wheel (111) is rotatably disposed. The main frame (1) is furnished with a first seat (12) on which a rib (121) is formed. A second seat (13) provided with a rib (131) is slidably mounted on the first seat (12) to move along the rib (121) of the first seat (12). A third seat (14) is slidably mounted on the second seat (13) to move along the rib (131) of the second seat (13). A L-shaped stand (2) is formed with a hole (21). A pin (211) passes through the hole (21) of the stand (2) and is secured to the third seat (14) to let the stand (2) pivotally mounted on the third seat (14) thereby capable of changing the relative position between the stand (2) and the grinding wheel (111). A shaft (22) passes through the hole (23) of the stand (2) and is provided at one end with a handle (24). A block (3) is secured to the other end of the shaft (22). The block (3) is provided with a dovetail groove (31). The center of the block (3) is formed with a recess (32) in which a gear (33) can be disposed. A knob (34) passes through the block (3) to be secured to the gear (33) therefore when the knob (34) is rotated, the gear (33) can be rotated therewith.

Figure 6:
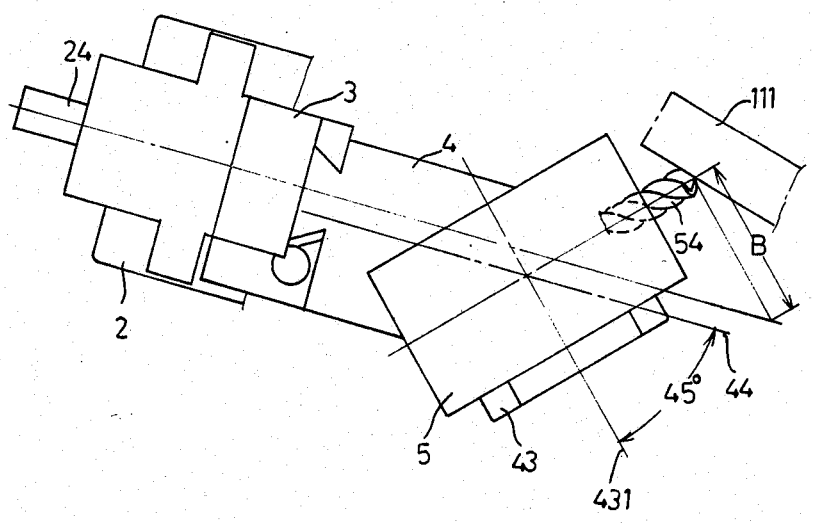
FIG. 6 is a simplified top view illustrating the drill bit being contacted with the grinding wheel and defining the vertical distance B thereof.

A sliding seat (4) is furnished with a dovetail (41) which corresponds to the dovetail groove (31) of the block (3) and can be moved therealong. A rack (42) is secured to the dovetail (41) to mesh in the gear (33) so that when the gear (33) is rotated in a predetermined manner the sliding seat (4) can be moved up or down along the dovetail groove (31) of the block (3). The sliding seat (4) is provided with a supporting plate (43) of which the central line (431) intersects the central line (44) of the sliding seat (4) at an angle of 45° (FIG. 6). A pair of pins (45) are respectively formed on both sides of the supporting plate (43).

Figures 1, 5:
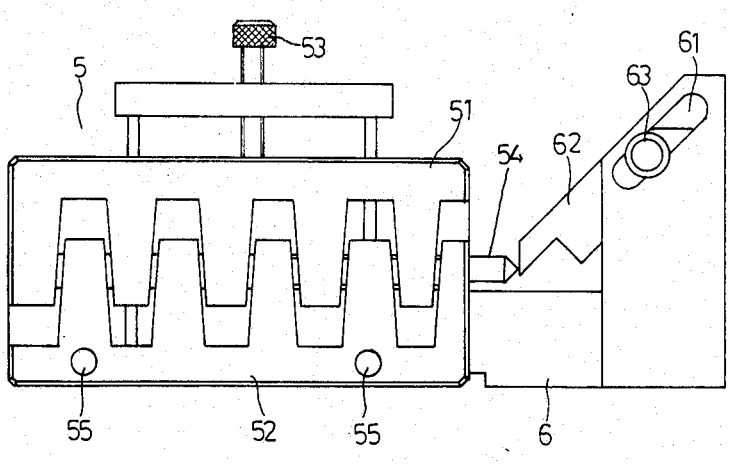
Figures 2, 5:
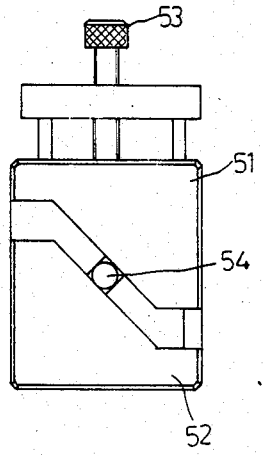

Referring to FIGS. 5-1 and 5-2, a clamping means (5) comprises a first seat (51) and a second seat (52). The first seat (51) can be adjusted by means of screw (53) to approach the second seat (52) so that the drill bit (54) can be properly clamped between the first and second seats (51) and (52). The second seat (52) is provided with a pair of positioning holes (55) (FIG. 5-1) which respectively correspond to the pins (45) of the supporting plate (43). The clamping means (5) can be mounted on the supporting plate (43) with the pins (45) thereof respectively inserting into the corresponding positioning holes (55). There are another pair of positioning holes (56) (FIG. 1) formed on the first seat (51) and the function thereof is similar to the positioning holes (55) of the second seat (52).

Figure 4:
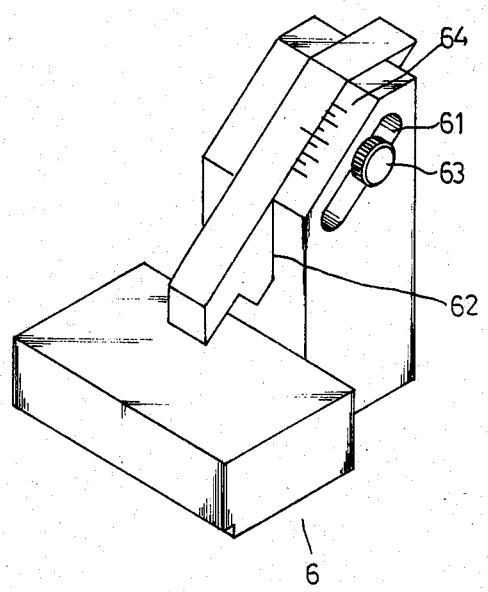
FIG. 4 is a perspective view of a positioning seat of a preferred embodiment of the present invention.

Referring to FIG. 4, a L-shaped positioning seat (6) is furnished with a slot (61) along which a positioning member (62) can move. The positioning member (62) is provided with a screw (63) by which it can be fixed at a specified position. There is a mark (64) formed on the top face of the positioning seat (6) to illustrate the specified position at which the positioning member (62) is located.

Referring to FIG. 6, after the clamping means (5) is mounted on the supporting plate (43) of the sliding seat (4) and the drill bit (54) disposed in the clamping means (5) is arranged to contact the grinding wheel (111) thereof, the vertical distance from the central axis of the handle (24) to the central axis of the drill bit (54) is defined as B.

In operation, firstly the drill bit (54) is disposed between the first and second seats (51) and (52). Secondly, the positioning member (62) of the positioning seat (6) is fixed at a specified position which is used to set the desired value of B. This will be described later. Thirdly, referring to FIGS. 5-1 and 5-2, the drill bit (54) is adjusted to contact the positioning member (62) and then is tightly clamped between the first and second seats (51) and (52). After so doing, the desired value of B can be accurately obtained. For example, if the positioning member (62) is fixed at the mark of 40 mm, after completing the above-noted procedure, the corresponding value of B will be set at 40 mm too. Fourthly, the clamping means (5) with the drill bit (54) fixed in the desired position is mounted on the supporting plate (43) of the sliding seat (4) as described hereinbefore.

Figure 7:
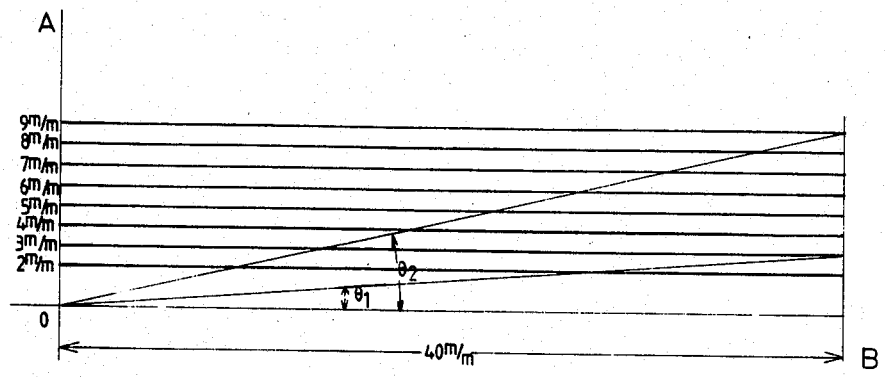
FIG. 7 shows that the clearance angle can be accurately defined by the values of A and B.

The vertical distance from the central axis of the handle (24) to the central axis of the drill bit (54) is defined as A (not shown). Since the clearance angle ($\theta$) can be accurately defined by the values of A and B we can rotate the knob (34) of the block (3) to adjust the vertical distance A thereof to a predetermined value so as to achieve the desired clearance angle ($\theta$). For illustration, referring to FIG. 7, the angle $\theta 1$ can be accurately defined by values B (40 mm) and A (3 mm) while the angle $\theta 2$ by values B (40 mm) and A (9 mm).

Figure 8:
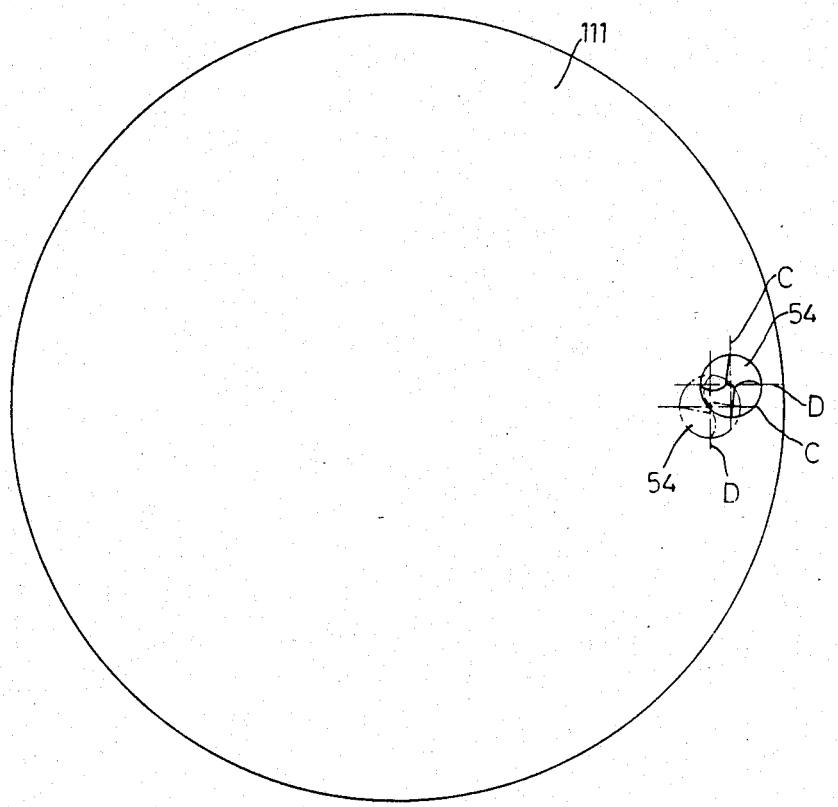
FIG. 8 shows the grinding position of the drill bit when in operation.
Figures 1, 9:
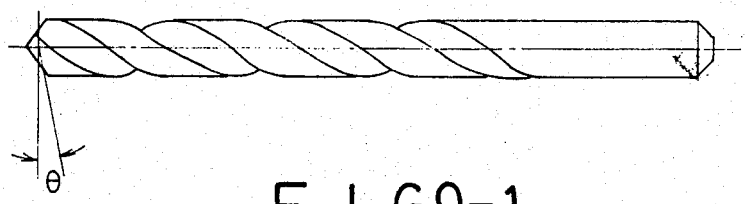
Figures 2, 9:
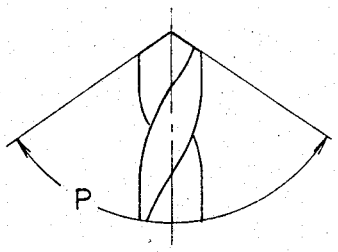

After completing the above-noted procedures, referring to FIG. 8, the second and third seats (13) and (14) are properly adjusted to let the portion (C) of the drill bit (54) contact the grinding wheel (111), as shown in the imaginary line of FIG. 8. Then rotate the handle (24) until the portion (D) of the drill bit (54) contacts the grinding wheel (111) as shown in the solid line of FIG. 8. Thus, the clearance angle ($\theta$) of the drill bit (54) can be accurately achieved after repeating the above-noted process a few times. Then, rearrange the clamping means (5) to make the pins (45) respectively be inserted into the positioning holes (56) of the first seat (51) and the another clearance angle can be similarly achieved.

Also, the point angle (P) of the drill bit (54) can be achieved by mans of adjusting the relative position between the stand (2) and the grinding wheel (111).

I claim:

1. An improved drill grinder comprising:

a main frame;

a grinding means being disposed on the main frame, a grinding wheel being rotatably disposed on the main frame;

a first seat on which a rib is formed being mounted on the main frame, a second seat being provided with a rib perpendicular to the rib of the first seat and being slidably mounted on the first seat to move along the rib of the first seat, a third seat being slidably mounted on the second seat to move along the rib of the second seat;

a L-shaped stand being pivotally mounted on the third seat to be capable of changing the relative position thereof to the grinding wheel of the grinding means, the stand being provided with a rotatable handle;

a block being secured to one end of the handle of the stand, the block being provided with a dovetail groove, the block being formed with a recess in which a gear is disposed, a knob passing through the block to be secured to the gear whereby when the knob is rotated, the gear can be rotated therewith;

a sliding seat being furnished with a dovetail which corresponds to the dovetail groove of the block and can be moved therealong, a rack being secured to the dovetail to mesh in the gear of the block whereby when the gear is rotated in a predetermined manner the sliding seat can be moved up or down along the dovetail groove of the block, the sliding seat being furnished with a supporting plate of which the central line intersects the central line of the sliding seat at an angle of 45°;

a clamping means comprising a first seat and a second seat, the first seat capable of being adjusted to approach the second seat so that a drill bit can be properly clamped between the first and second seats, the clamping means capable of being mounted on the supporting plate of the sliding seat whereby the drill bit is arranged to contact the grinding wheel;

a L-shaped positioning seat being furnished with a slot along which a positioning member can move, the positioning member being provided with a screw by which it can be fixed at a specified position, a mark being formed on the positioning seat to illustrate the specified position at which the positioning member is located.

* * * * *